US005701743A

United States Patent [19]

Hagiwara et al.

[11] Patent Number: 5,701,743

[45] Date of Patent: Dec. 30, 1997

[54] PULSE TUBE REFRIGERATOR

[75] Inventors: Yasumasa Hagiwara; Shinichi Yatsuzuka, both of Kariya, Japan

[73] Assignee: Advanced Mobile Telecommunication Technology Inc., Nisshin, Japan

[21] Appl. No.: 722,873

[22] Filed: Sep. 26, 1996

[30] Foreign Application Priority Data

Nov. 1, 1995 [JP] Japan ..... 7-285360

[51] Int. Cl.[6] ..... F25B 9/00

[52] U.S. Cl. ..... 62/6; 60/517

[58] Field of Search ..... 62/6; 60/517

[56] References Cited

U.S. PATENT DOCUMENTS

| | | | |
|---|---|---|---|
| 5,269,147 | 12/1993 | Ishizaki et al. | 62/6 |
| 5,275,002 | 1/1994 | Inoue et al. | 62/6 |
| 5,335,505 | 8/1994 | Ohtani et al. | 62/6 |
| 5,435,136 | 7/1995 | Ishizaki et al. | 60/517 |
| 5,481,878 | 1/1996 | Shaowei | 62/6 |
| 5,522,223 | 6/1996 | Yanai et al. | 62/6 |

*Primary Examiner*—Christopher Kilner
*Attorney, Agent, or Firm*—Cushman, Darby & Cushman IP Group of Pillsbury Madison & Sutro LLP

[57] ABSTRACT

To improve cooling efficiency of a pulse tube refrigerator, it is found that creating two conditions in the refrigerator, particularly in a regenerator is effective. In a first condition, working fluid in the regenerator should be compressed or expanded without having any displacement thereof, while it should be displaced without compression or expansion in a second condition. In order to realize this idea, a fluid displacement control valve assembly including two relief valves is disposed between a pulse tube and a buffer tank. Each of the relief valves is a normally closed one-way valve, and the valves open in opposite directions to one another when a pressure difference between the pulse tube and the buffer tank reaches a predetermined value, thus allowing the working fluid to be displaced after its compression from the pulse tube to the buffer tank and after its expansion from the buffer tank to the pulse tube. Further, an electro-magnetic valve is installed in parallel with a set of the regenerator and the pulse tube. The electro-magnetic valve is controlled so that it opens or closes in an alternate timing with the fluid displacement control valve assembly, thus making it possible to pressurize the working fluid from both ends of the set of the regenerator and the pulse tube and to bring a cool end portion which cools off an article to be cooled to a neighborhood of a nodal point of a standing wave generated by a compressor.

5 Claims, 9 Drawing Sheets

PULSE TUBE REFRIGERATOR

CROSS-REFERENCE TO RELATED APPLICATION

The present application is related to and claims priority from Japanese Patent Application No. Hei-7-285360, incorporated herein by reference.

BACKGROUND OF THE INVENTION

1. Field of the Invention

The present invention generally relates to pulse tube refrigerators, and more particularly to a pulse tube refrigerator for effectively cooling objects such as superconductive material elements and infrared sensor elements.

2. Description of Related Art

As described in the Japanese Laid-Open Patent Publication No. Hei-5-106926, a pulse tube refrigerator generally comprises a regenerator with a high heat capacity containing stainless steel or bronze meshes or a number of small balls, a cool end portion formed at one end of the regenerator, a pulse tube connected to and extending from the cool end portion, working fluid such as He, Ar or $N_2$ disposed in the regenerator and the pulse tube, and a compressor with a piston for displacing the working fluid. Cryogenic temperature is achieved at the cool end portion by displacing the working fluid with the compressor. As exemplified above, the pulse tube refrigerator is simple in construction and has no moving parts at the cool end portion. Therefore, it has high reliability and can be operated without maintenance for a long time.

However, the working mechanism of the pulse tube refrigerator has not been clarified completely yet and therefore it is necessary to use trial and error in designing the refrigerator system. The inventors of the present invention have tried to clarify the working mechanism through various tests and experiments and reached a conclusion which will be explained below.

In the pulse tube refrigerator, the regenerator plays a big role in heat transport from the cool end to the hot end. The way of heat transport is similar to that of transferring water in a bucket A to a bucket B with a sponge. In this analogy, water corresponds to heat and the sponge to the working fluid. In order to transfer water, the sponge is compressed and then it is dipped into the water in the bucket A. The compressed sponge is released or expanded in the water to suck up water thereinto. The sponge with the sucked water is carried to the bucket B and compressed again to release the water into the bucket B. Thus, water is transferred or carried from the bucket A to the bucket B. This analogy will be useful to explain the working mechanism of the pulse tube refrigerator.

To explain the mechanism of the heat transport in the pulse tube refrigerator system, the words, "Standing Wave" and "Progressive Wave" are defined here as follows: A) "Standing Wave": displacement of the working fluid that varies in the same phase as pressure variation (working fluid displacement caused by compression or expansion thereof); B) "Progressive Wave": displacement of the working fluid that varies independently from compression or expansion of the fluid. The explanation below is made under the following assumptions: a) the working fluid in the regenerator is compressed isothermally and therefore the heat generated by compression is completely absorbed by the regenerator; and b) the expansion of the working fluid in the regenerator is isothermal and therefore the fluid absorbs all the heat required in expansion from the regenerator. The displacement of a small volume element of the working fluid includes both of the displacements caused by the standing wave and the progressive wave in the following discussion of the working mechanism of the pulse tube refrigerator. In order to avoid any complication in the following discussion, the displacement of the working fluid is considered only in one direction, i.e., an axial direction of the regenerator (one dimensional model). It is assumed that the heat capacity of the regenerator is large enough so that temperature change caused by heat exchange between the working fluid and the regenerator can be neglected and that temperature distribution within the regenerator is uniform.

In FIGS. 2 and 3, the relation between pressure and displacement is shown schematically (the abscissa represents displacement and the ordinate pressure), focusing on a small volume element of the working fluid in the regenerator during one cycle consisting of compression and expansion.

FIG. 2 shows the pressure and displacement relation of a small volume element of the working fluid at a nodal point of the standing wave (a point where no displacement exists) under the condition that there is no progressive wave. As seen in FIG. 2, the pressure of the small volume element increases according to lapse of time (from the point 0 to the point A) and the heat generated by the compression is completely absorbed by the regenerator because the compression is isothermal under the afore-mentioned assumption a). Then, the compressed small volume element expands and the pressure decreases according to further lapse of time (from the point A to the point B through the point 0). Under the assumption b), the small volume element expands isothermally and the heat required in the expansion is absorbed from the regenerator. The small volume element is again compressed isothermally with pressure increase therein (from the point B to the point A through the point 0). During the course of the cycle where no progressive wave exists, there is no heat transport because the heat moves back and forth only between the regenerator and the working fluid at the same place of zero displacement as in FIG. 2.

The behavior of a small volume element at a neighborhood of a nodal point of the standing wave where no progressive wave exists is shown in FIG. 3. As seen here, the small volume element is displaced according to the standing wave variation along the line shown (0→A→0→B). In other words, the small volume element is isothermally compressed as time lapses from the point 0 to the point A and is isothermally expanded during the course from the point A to the point B through the point 0. The small volume element is again compressed in the course of moving from the point B to the point A.

In either case shown in FIG. 2 and FIG. 3, where no progressing wave exists and the pressure and displacement relation moves along a line, there is no heat transport.

Next, the situation where both of the standing wave and the progressive wave exist will be discussed. In order to make the discussion simple, the standing wave is assumed to be a sine wave and the progressing wave a cosine wave. A locus showing the pressure and displacement relation, in the situation where both of the standing and progressing waves exist, can be drawn by adding up the pressure variation of the standing wave and the displacement caused by the progressive wave.

The pressure and the displacement relation of the small volume element at the nodal point of the standing wave under the presence of the progressive wave can be shown as in FIG. 4. As time passes from the point A to the point B, a small volume element is compressed isothermally along with the displacement thereof and the heat generated therein is completely absorbed by the regenerator. During the course of movement from the point B to the point C, the small volume element is isothermally expanded and it continues to be expanded until it reaches the point D. This expansion is caused along with the displacement of the element. During the course of the expansion, the heat required for the expansion is absorbed from the regenerator to the working liquid. At the point D, the expansion turns to the compression which continues until the element reaches the point B through the point A.

As for a small volume element at a neighborhood of a nodal point of the standing wave, the pressure and the displacement relation can be drawn as in FIG. 5. Since a small displacement caused by the pressure change of the standing wave should also be added in this case, the locus becomes an oval shape. From the point A to the point B the element is isothermally compressed and the isothermal expansion begins at the point B which continues to the point D through the point C. The isothermal compression starts again at the point D and continues to the point B.

As discussed above, under the presence of the progressive wave, the position where the heat is absorbed by the working liquid in the expansion process is different from the position where the absorbed heat is released to the regenerator in the compression process. Therefore, the heat can be transferred from the position of expansion to that of the compression. In other words, the heat is transferred from the right side to the left side of the chart in FIG. 4. Since the heat transport is carried out in the same manner as described above throughout the whole length of the regenerator, the heat can be transferred consecutively in one direction from the position of the expansion to the position of compression. Accordingly, one end of the regenerator, i.e., the position of the expansion is gradually cooled off even to a cryogenic temperature.

Improvements of the cooling efficiency of the pulse tube refrigerator should be considered on the basis of the working mechanism mentioned above. The cooling efficiency improvement is similar to improvement of the efficiency of water transfer in the afore-mentioned analogy of transferring water from one bucket to another bucket using a sponge.

Therefore, to improve the cooling efficiency, the following two approaches can be considered. The first approach is to increase the volume of water to be carried by the sponge at a time, more specifically, the volume of the water absorbed into the sponge in one soaking action must be increased. To achieve this, the sponge must be expanded while it stays at a same place relative to water in the bucket. The second approach is to separate the place where the water is absorbed into the sponge from the place where the absorbed water is squeezed out in order to avoid mixing the water to be transferred and the water already transferred.

In the light of the above analogy, the cooling efficiency of the pulse tube refrigerator can be improved in the following manner. The working fluid must absorb from and release to the regenerator as much heat as possible in the processes of its expansion and compression. In other words, the flow velocity of the working fluid must be slow so that it can contact the regenerator at the same place for a sufficiently long time. Also, the positions of the liquid expansion and compression must be clearly separated so that the heat to be transferred and the heat already transferred do not mix with each other.

SUMMARY OF THE INVENTION

In view of the above discussion, it is an object of the present invention to improve the cooling efficiency of the pulse tube refrigerator.

As clarified in the description of the preferred embodiment of the present invention, two relief valves which control the flow of the working fluid are disposed between a pulse tube and a buffer tank, so that a pulse tube refrigerator operates in two conditions; the one condition where the working fluid in a regenerator is compressed or expanded without any displacement thereof and the other condition where the working fluid is displaced without being accompanied by any compression or expansion. In this context, the displacement of the working fluid means the displacement caused by a progressive wave. The relief valves are controlled in such a way that they open when a pressure difference between the pulse tube and buffer tank reaches a predetermined value and close when the pressure difference is below the predetermined value.

Since the pulse tube refrigerator according to the present invention operates under these two conditions, it is possible to make a flow velocity of the working fluid low and to separate positions of compression and expansion of the working fluid. Thus, efficiency of the pulse tube refrigerator can be improved as mentioned above. More specifically, when the relief valves are closed, the working fluid is compressed or expanded, and when these are open, the working fluid is displaced. In addition, due to the operation of the relief valves, the progressive wave causing the displacement of the working fluid varies in a rectangular shape under a cosine wave pressure generated by a usual piston-type compressor. The rectangular progressive wave can carry more heat per one cycle, compared with the case of an alternative wave like a cosine wave. Thus, the efficiency of the pulse tube refrigerator can be further improved.

Further, in the present invention, a bypass pipe with a control valve can be connected in parallel to a set of the regenerator and the pulse tube. Through this bypass pipe, the pressure given to the working fluid in the regenerator by a compressor can be applied to the working fluid in the pulse tube without going through the regenerator. The control valve is open when the relief valves are closed and it is closed when the relief valves are open. This control valve can be replaced by an orifice limiting the working fluid flow in the bypass pipe.

In a refrigerator system with the bypass pipe, a nodal point of the standing wave can be brought to a neighborhood of the cool end portion which is between the regenerator and the pulse tube, because the pressure is applied to both sides of the set of the regenerator and the pulse tube. Bringing the nodal point to a neighborhood of the cool end portion further contributes to improvement of the efficiency of the pulse tube refrigerator. In the system with the bypass pipe having the control valve which is closed when the working fluid is being displaced, the working fluid is not compressed or expanded during the displacement stage. In the system in which the control valve is replaced by the orifice, the system can be operated similarly with a little disadvantage that the orifice cannot completely prevent the working fluid compression and expansion during the displacement stage.

BRIEF DESCRIPTION OF THE DRAWINGS

Additional objects and advantages of the present invention will be more readily apparent from the following detailed description of preferred embodiments thereof when taken together with the accompanying drawings in which.

DETAILED DESCRIPTION OF THE PREFERRED EMBODIMENTS

The preferred embodiments of the present invention will be hereinafter described with reference to the accompanying drawings.

Figure 1:
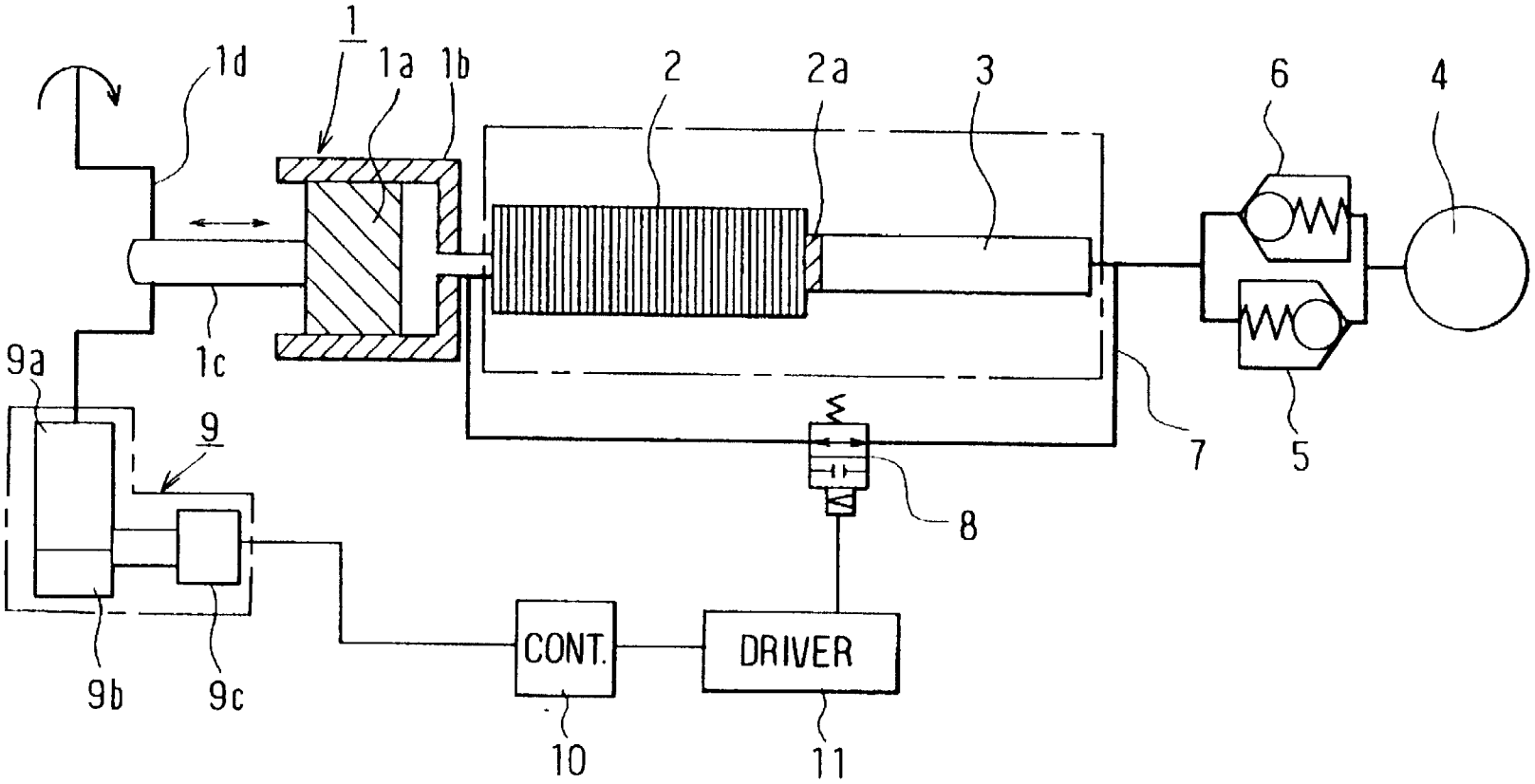
FIG. 1 is a schematic drawing showing a first embodiment of the pulse tube refrigerator according to the present invention.
Figure 2:
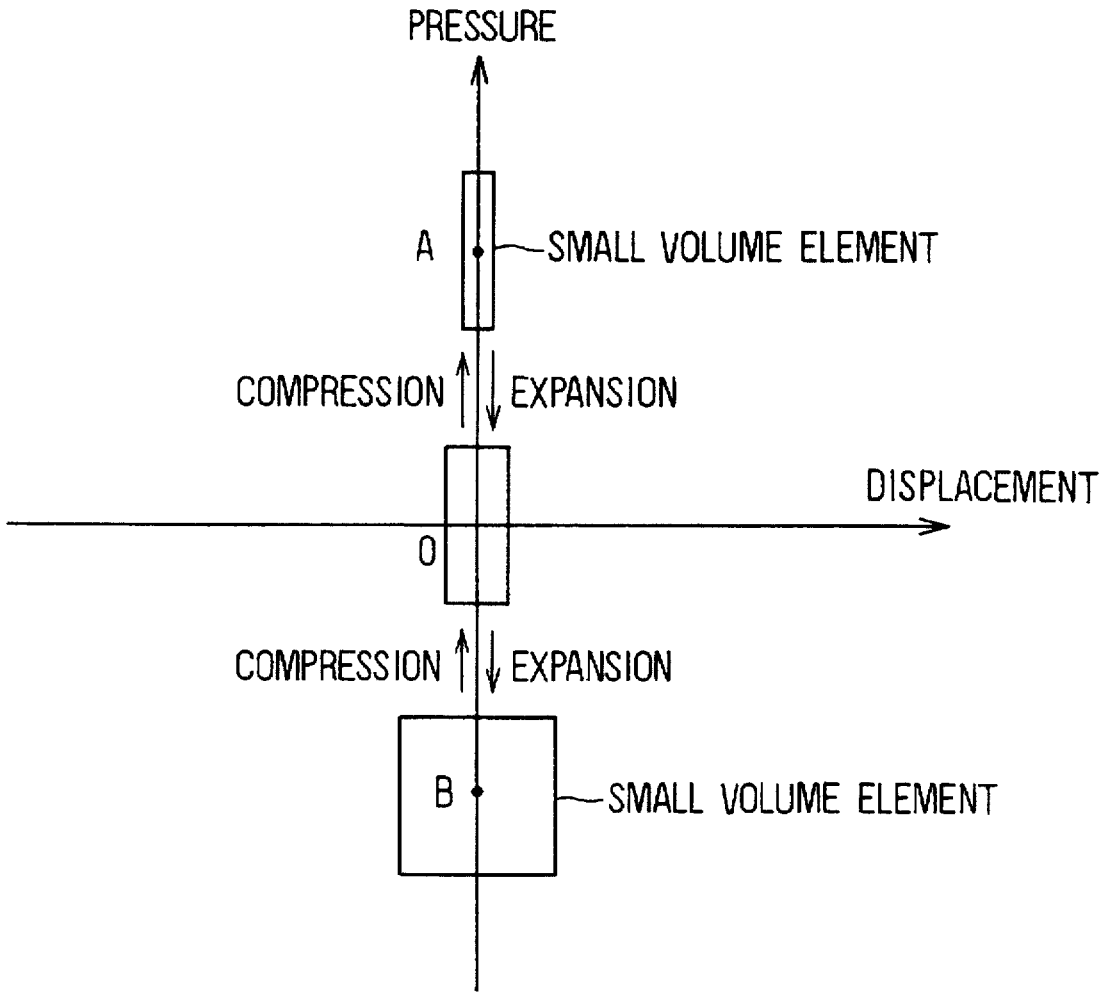
FIG. 2 is a chart for explaining the pressure and displacement relation at a nodal point of a standing wave when there is no progressive wave in a regenerator.
Figure 3:
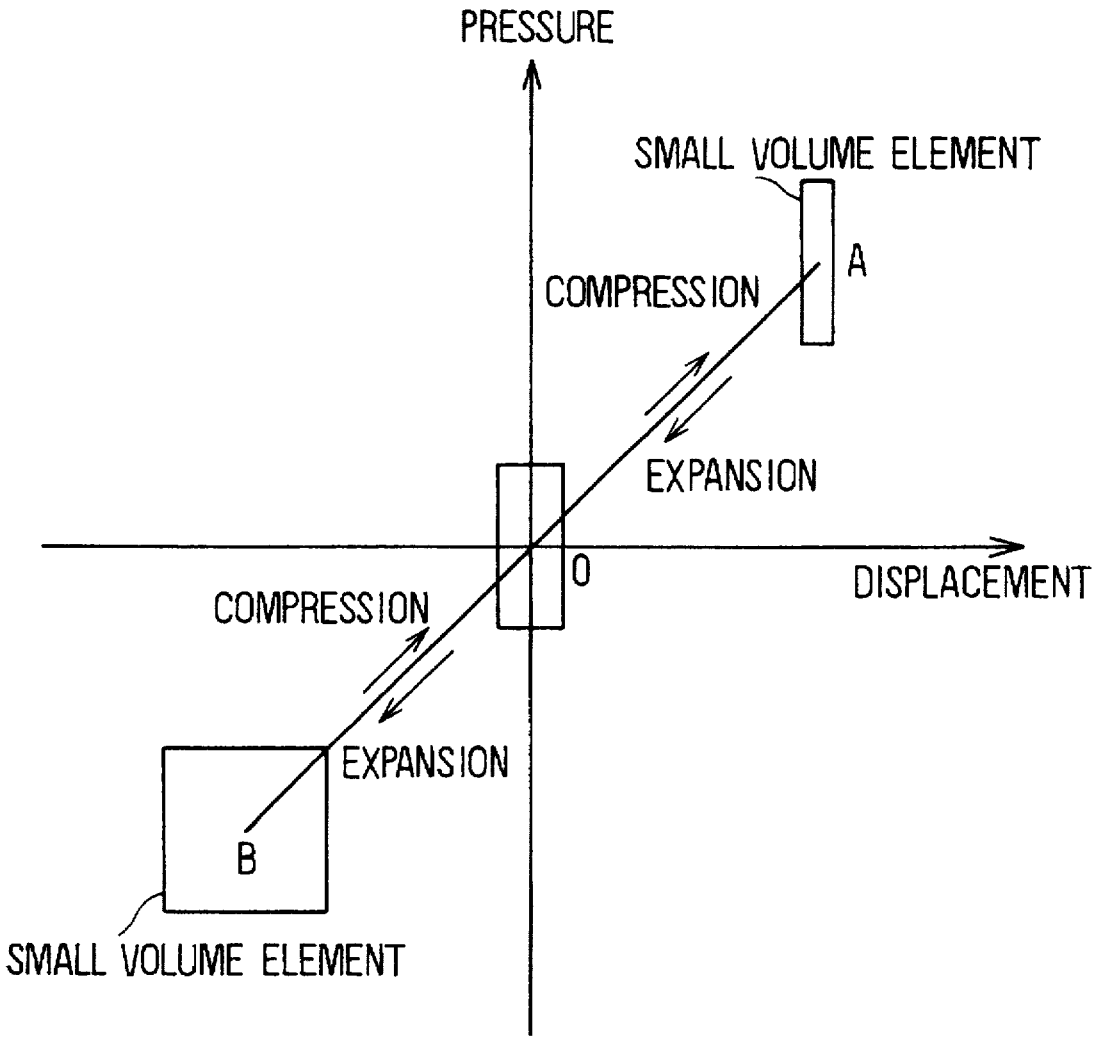
FIG. 3 is a chart for explaining the pressure and displacement relation at a neighborhood of a nodal point of a standing wave when there is no progressive wave in a regenerator.

FIG. 1 shows schematically a first embodiment of the pulse tube refrigerator according to the present invention. In FIG. 1, a compressor 1 with a reciprocating piston 1*a* serves as a working fluid driver in this system. The working fluid such as He, $N_2$, $H_2$, Ar, or Ne is compressed or expanded by the compressor 1, generating a standing wave, and displaced by the compressor 1, forming a progressive wave.

A regenerator 2 absorbs heat from the working fluid and releases heat thereto. The regenerator is formed by laminating meshes made of metal such as copper or copper alloy, or by filling metal balls made of stainless steel or lead etc. in an enclosed container. The regenerator 2 absorbs heat quickly from the working fluid therein during its compression stage and releases heat quickly to the working fluid during its expansion stage. Therefore, the regenerator 2 must be composed of a material that has a sufficiently large heat capacity and a relatively high heat conductivity. However, axial heat conduction in the regenerator from the compressor side to the cool end portion 2*a* which is mounted on the regenerator at the opposite side of the compressor 1 should be kept as low as possible, in order to keep cooling efficiency high at the cool end portion 2*a*. For this purpose, it is desirable to laminate the metal meshes in the regenerator 2 in the axial direction. The cool end portion 2*a* mounted on the cool end of the regenerator has to be made of metal having a high heat conductivity such as copper or indium, etc., because an article to be cooled down is directly mounted on the cool end portion 2*a*.

A pulse tube 3 is connected next to the cool end portion 2*a* so that the working fluid in the regenerator 2 passes into the pulse tube 3. The pulse tube 3 is a thin metal tube made of stainless steel, titanium, titanium alloy or the like.

A buffer tank 4 is connected to the pulse tube 3 through a fluid displacement control valve assembly including a first relief valve 5 and a second relief valve 6. The buffer tank 4 temporarily reserves the working fluid displaced from the pulse tube 3, and the two relief valves 5 and 6 are so constructed as to be normally closed and become open when the pressure difference between the pulse tube 3 and the buffer tank 4 reaches a predetermined value. The first relief valve 5 is set to prevent fluid displacement from the pulse tube 3 and the second relief valve 6 is set to prevent fluid displacement from the buffer tank 4.

As seen in FIG. 1, the compressor 1, the regenerator 2, the cool end portion 2*a*, the pulse tube 3, the relief valves 5 and 6, and the buffer tank 4 are connected in series in a direction of the working fluid displacement. The regenerator 2, the cool end portion 2*a* and the pulse tube 3, all of which are encompassed within dotted lines in FIG. 1, are disposed in a vacuum container (not shown in the drawing) to shut down heat conduction to the outside.

A bypass pipe 7 is connected in parallel with the set of regenerator 2 and the pulse tube 3, so that the pressure given to the working fluid by the compressor 1 can also be supplied to the right end (the other end opposite to the cool end portion 2*a*) of the pulse tube 3. A control valve, particularly in this embodiment, an electro-magnetic valve 8, is installed in the bypass pipe 7 so that the working fluid pressure communication in the pipe can be controlled by the electro-magnetic valve 8.

The compressor 1 includes a piston 1*a*, a cylinder 1*b*, a connecting rod 1*c* and a crank 1*d*, and is driven by a servomotor 9. The servomotor 9 is composed of a motor 9*a*, an encoder 9*b* and a motor driver 9*c*, and is controlled by a controller 10 having a microprocessor. The controller 10 also controls the electro-magnetic valve 8 by controlling a valve driver 11 according to signals sent from the encoder 9*b*.

Figures 6A, 6B, 6C, 6D, 6E:
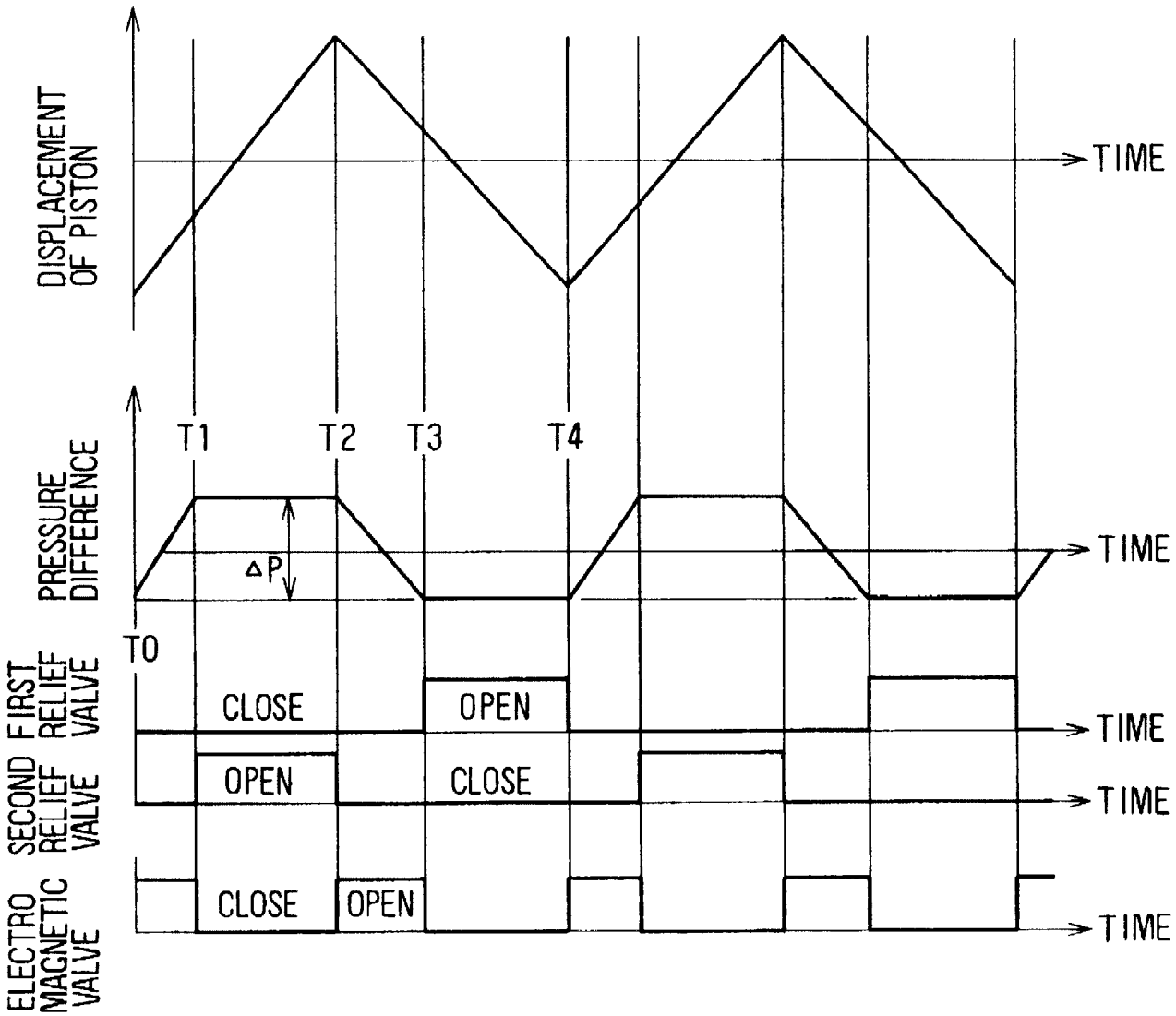
FIG. 6A –6E are graphs showing the operation of the pulse tube refrigerator of the present invention.
Figure 7:
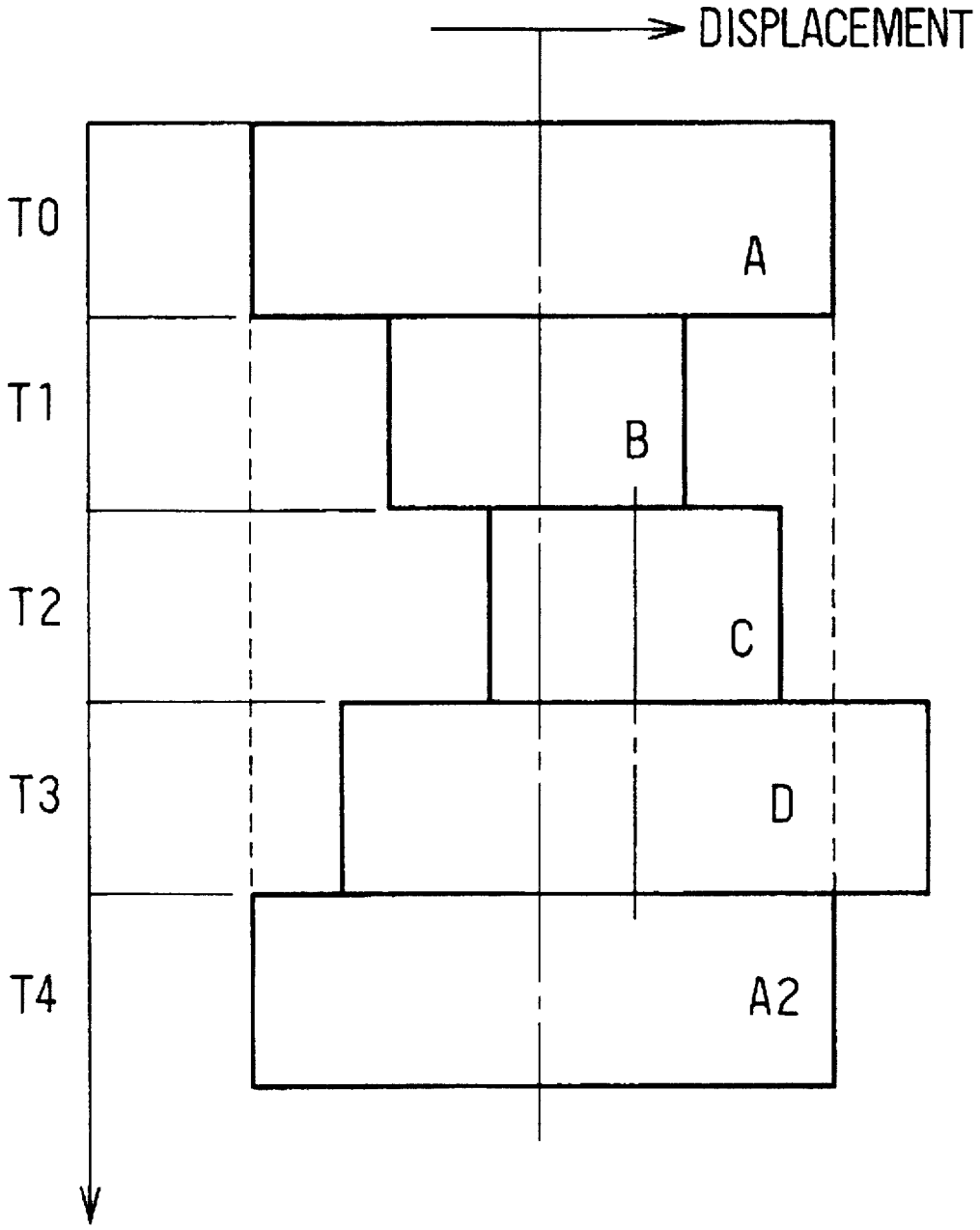
FIG. 7 is a schematic diagram illustrating the volume change and displacement of a small volume element of the working fluid in the regenerator.

The operation of the first embodiment is now explained according to FIGS. 6A –6E and 7. FIG. 6A is a graph showing the displacement of the piston 1*a*; FIG. 6B shows the pressure difference between the pulse tube 3 and the buffer tank 4; FIG. 6C and FIG. 6D show the open-or-closed state of the first and second relief valves 5 and 6, respectively, and FIG. 6E shows the open-or-closed state of the electro-magnetic valve 8. In these graphs, time starts at the point where the piston 1*a* is at a bottom dead center (i.e.,the time when the volume defined by the piston la and the cylinder 1*b*becomes maximum). FIG. 7 is a schematic diagram showing the volume change and the displacement of the small volume element of the working fluid in the regenerator 2.

Referring to these graphs, when the piston 1*a* is at the bottom dead center (at T0), the first and second relief valves 5 and 6 are closed and the electro-magnetic valve 8 is open. From this position, the piston 1*a* moves toward the top dead center (i.e.,the volume defined by the piston 1*a* and the cylinder 1*b* becomes minimum) and the working fluid in the regenerator 2 begins to be compressed. This compression process continues until it reaches the timing T1, and the state of the small volume element of the working fluid changes from the state A (at T0) to the state B (at T1) as shown in FIG. 7. During the compression process, the pressure is applied to the working fluid directly from the compressor 1 and from the right end of the pulse tube 3 as well.

At the timing T1 the pressure difference between the regenerator 2 and the buffer tank 4 reaches a predetermined value (relief pressure), and the second relief valve 6 becomes open and the electro-magnetic valve 8 closes at the same time. At this point, the pressure increase in the regenerator 2 stops. The working fluid in the regenerator 2 begins to flow into the buffer tank 4 (displacement of the working fluid). From the timing T1 to the timing T2, the working fluid in the regenerator 2 is displaced toward the buffer tank through the pulse tube 3 while the working fluid pressure is kept constant at the relief pressure. The state of the small volume element of the working fluid in the regenerator 2 changes from the state B (at T1) to the state C (at T2) as in FIG. 7.

When the piston 1*a*reaches the top dead center and the expansion process begins at the timing T2, the second relief valve 6 is closed because the displacement direction of the working fluid is switched. At the same time, the electro-magnetic valve 8 is opened and the expansion process begins. This process continues until it reaches the timing T3. The state of the small volume element of the working fluid in the regenerator 2 changes from the state C (at T2) to the state D (at T3).

When the pressure difference between the regenerator 2 and the buffer tank 4 reaches the predetermined value (the relief pressure) at the timing T3, the first relief valve 5 becomes open and the electro-magnetic valve 8 is closed. At this point, the expansion of the working fluid in the regenerator 2 stops and the fluid stored in the buffer tank 4 begins to be displaced toward the regenerator 2. This continues from the timing T3 to the timing T4 while the working fluid pressure is kept constant at the relief pressure. The state of the small volume element of the working fluid in the regenerator 2 changes from the state D (at T3) to the state A2 (at T4).

At the timing T4 the piston 1*a*reaches the bottom dead center again and the first relief valve 5 is closed due to the flow direction change therein. At the same time the electro-magnetic valve 8 is opened. The processes above-explained form one cycle of the pulse tube refrigerator according to the present invention and this cycle is repeated continuously. In these processes, the opening or closing of the electro-magnetic valve 8 is controlled by the controller 10 which calculates the open-or-close timing of the relief valves 5 and 6 according to the information as to the position of the piston 1*a*.

Figure 4:
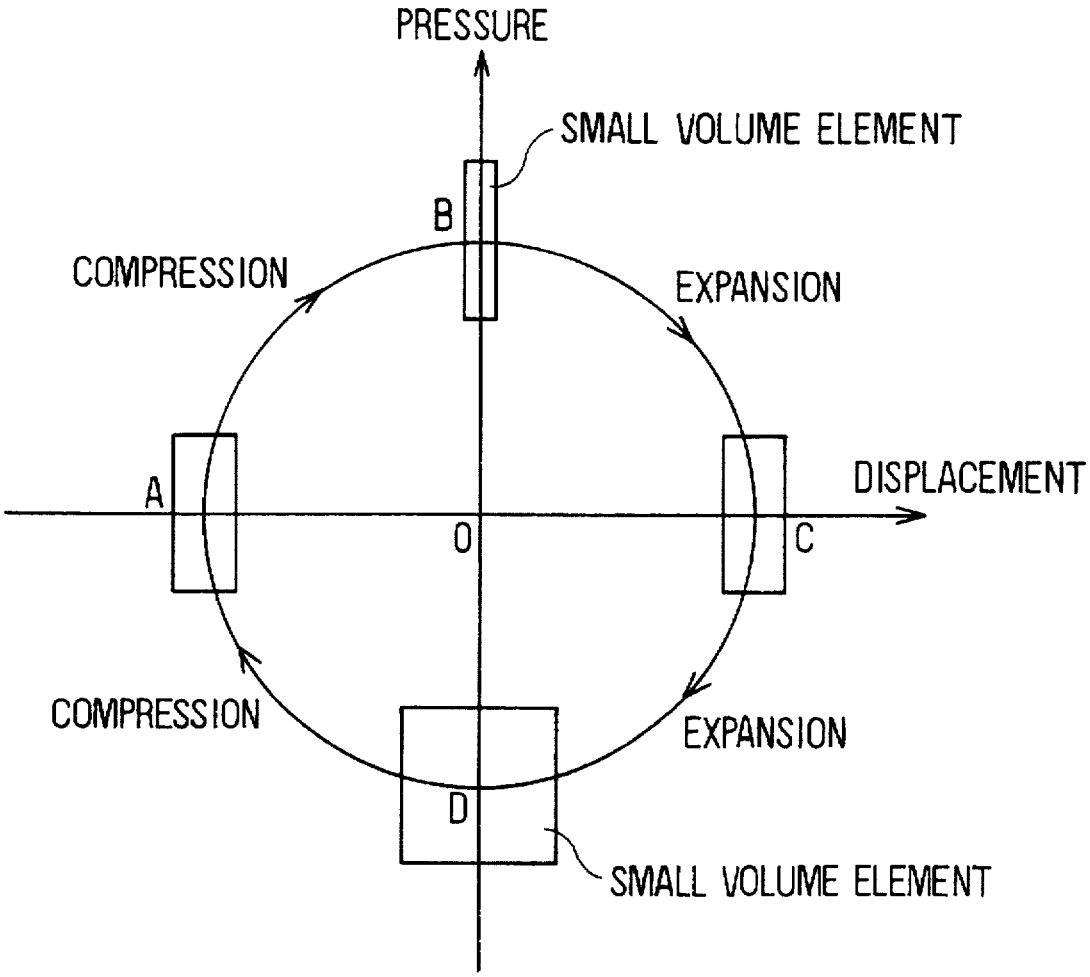
FIG. 4 is a chart for explaining the heat transport in a regenerator at a nodal point of a standing wave when there is a progressive wave in a regenerator.
Figure 5:
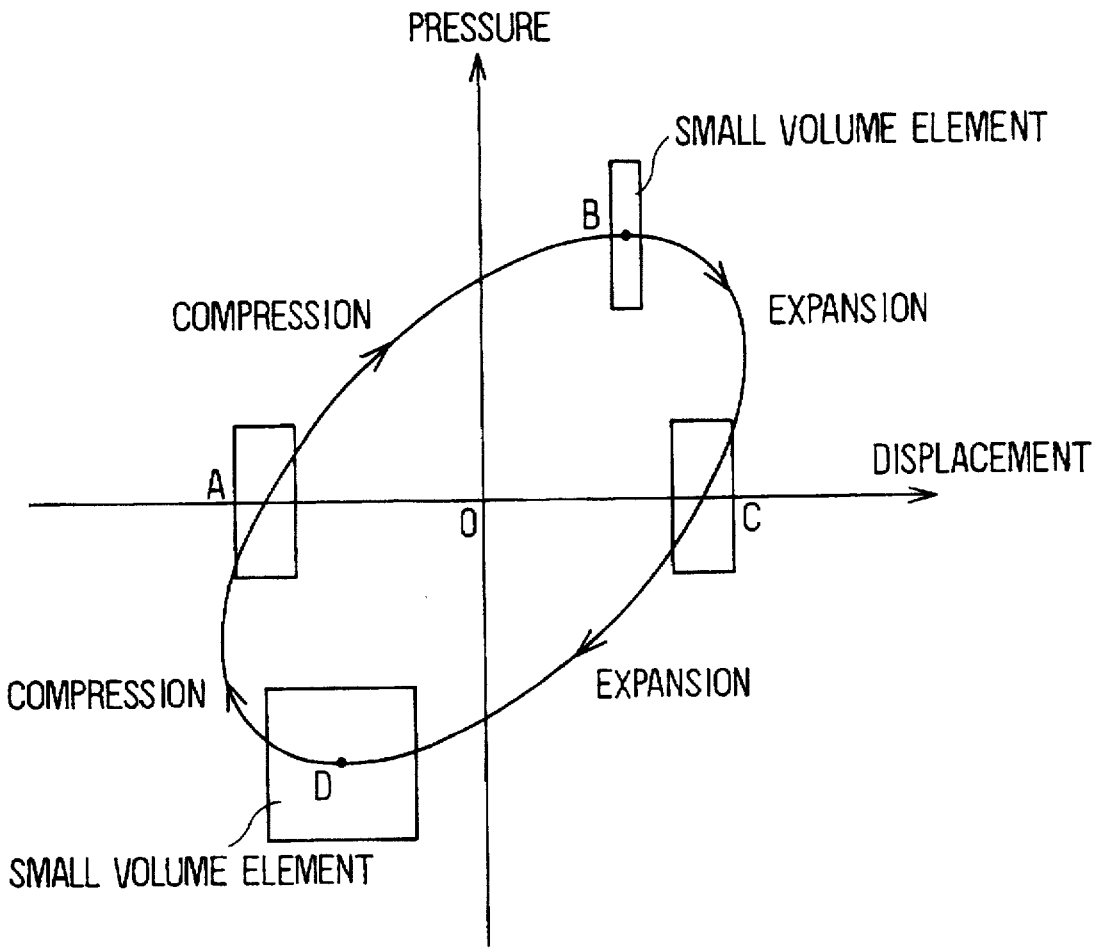
FIG. 5 is a chart for explaining the heat transport in a regenerator at a neighborhood of a nodal point of a standing wave when there is a progressing wave.
Figure 8:
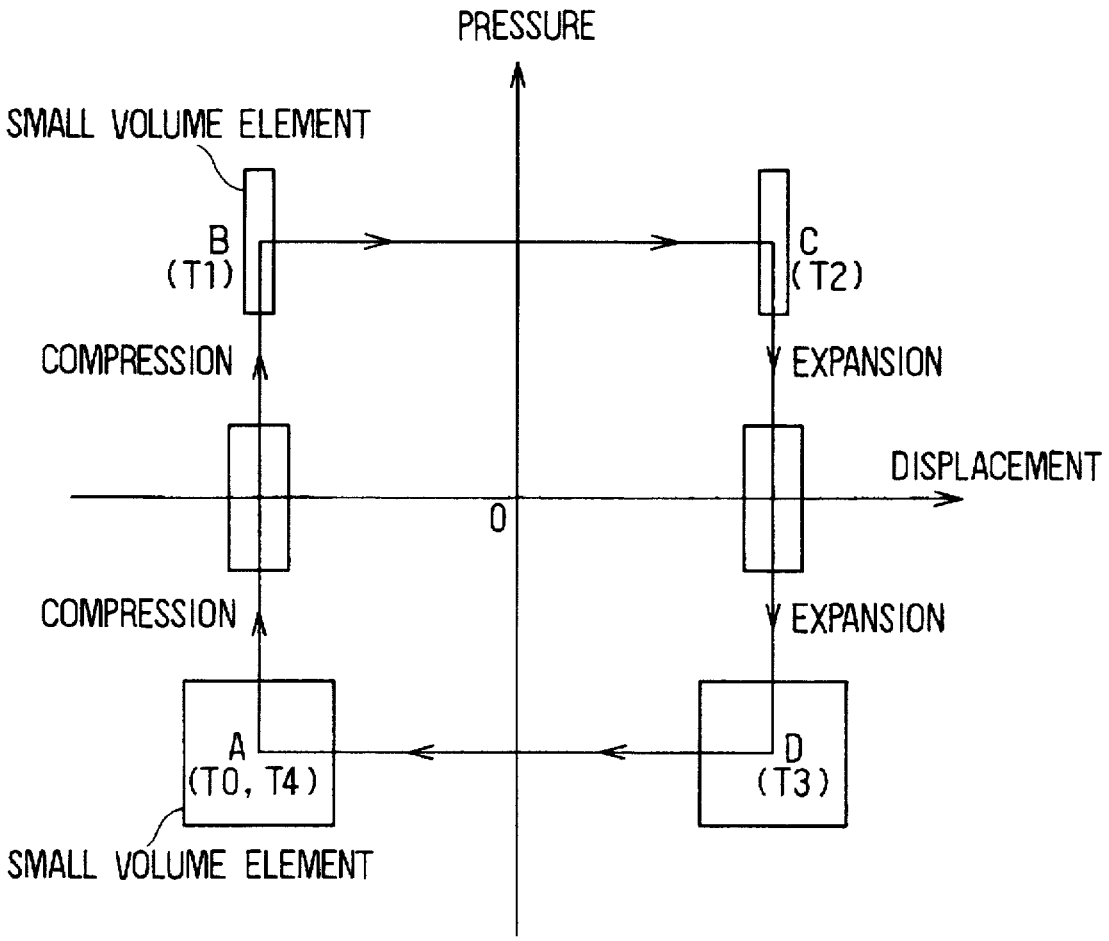
FIG. 8 is a schematic diagram illustrating the pressure and displacement of a small volume element of the working fluid in the regenerator of the present invention.

The pressure and displacement relation of the working fluid in the regenerator 2 at the nodal point of the standing wave can be drawn as in FIG. 8 which is drawn in the same way as FIG. 4. In FIG. 4, the displacement direction from the left side to the right side in the regenerator 2 (referring to FIG. 1) is taken as a plus direction.

In FIG. 8, the state of the small volume element changes from A to B in the compression process which corresponds to the period from T0 to T1 in FIGS. 6A–6E. Since there is no displacement in the compression process, the locus of the change moves in parallel with the ordinate. Then, the small volume element is displaced from B to C in parallel with the abscissa because there is no pressure change in this period which corresponds to the period from T1 to T2 in FIGS. 6A–6E. The state of the small volume element changes from C to D in the expansion process which corresponds to the period from T2 to T3 in FIGS. 6A–6E. In this process the change occurs in parallel with the ordinate without being accompanied by any displacement. Then, the small volume element is displaced from D to A in parallel with the abscissa because it moves from the right side to the left side in the regenerator 2 without having any pressure change. This displacement period corresponds to that from T3 to T1 in FIGS. 6A–6E.

As described above, the heat moves from right to left in FIG. 8. In other words, the heat is consecutively transferred from the right side of the regenerator 2 to the left side thereof. Therefore, the right side of the regenerator 2 where the cool end portion 2*a* is mounted is cooled down and the heat transported to the left side is radiated to the atmosphere through a radiator (not shown in the drawings) or through the cylinder 1*b* of the compressor 1.

As has become apparent in the foregoing description, the working fluid in the regenerator 2 is not displaced when it is compressed or expanded, and it is displaced when it is not compressed or expanded. Therefore, it is possible to make the fluid velocity low in the compression or the expansion process and to separate the position of compression from that of expansion. In this way, the efficiency of the pulse tube refrigerator can be greatly improved. Moreover, since the progressive wave to separate the compression and expansion positions is a rectangular wave, a larger amount of heat can be transferred in one cycle, compared with a conventional system in which the progressive wave is a cosine wave or the like. Also, it is very difficult to obtain the rectangular progressive wave in a system, such as a so-called double piston—type pulse tube refrigerator, in which two compressors are used—one is installed at the refrigerator end and the other at the pulse tube end. The compressors cannot be controlled to obtain the rectangular progressive wave due to inertia of the piston and the motor. According to the present invention, it is not required to control the compressor piston to generate the rectangular wave in order to obtain the rectangular progressive wave in the system.

To further clarify the advantage of the present invention in which the relief valves 5 and 6 are disposed between the pulse tube 3 and the buffer tank 4, a conventional system, i.e., a so-called a double inlet-type pulse tube refrigerator in which a fixed orifice is used in place of the relief valves in the present invention, is taken up for reference. In the refrigerator with the fixed orifice, the working fluid in the regenerator can be displaced even in the compression or expansion process. Therefore, it is not possible to separate the position of compression from that of expansion as opposed to the system according to the present invention.

In addition, since the bypass pipe 7 with the electro-magnetic valve 8 is installed in the system of the present invention as shown in FIG. 1, the working fluid in the regenerator 2 can be pressurized from both sides, i.e., the compressor side (left) and the pulse tube side (right). Therefore, the nodal point of the standing wave can be set at a neighborhood of the cool end portion 2*a*, thereby further improving the efficiency of the pulse tube refrigerator.

Figure 9:
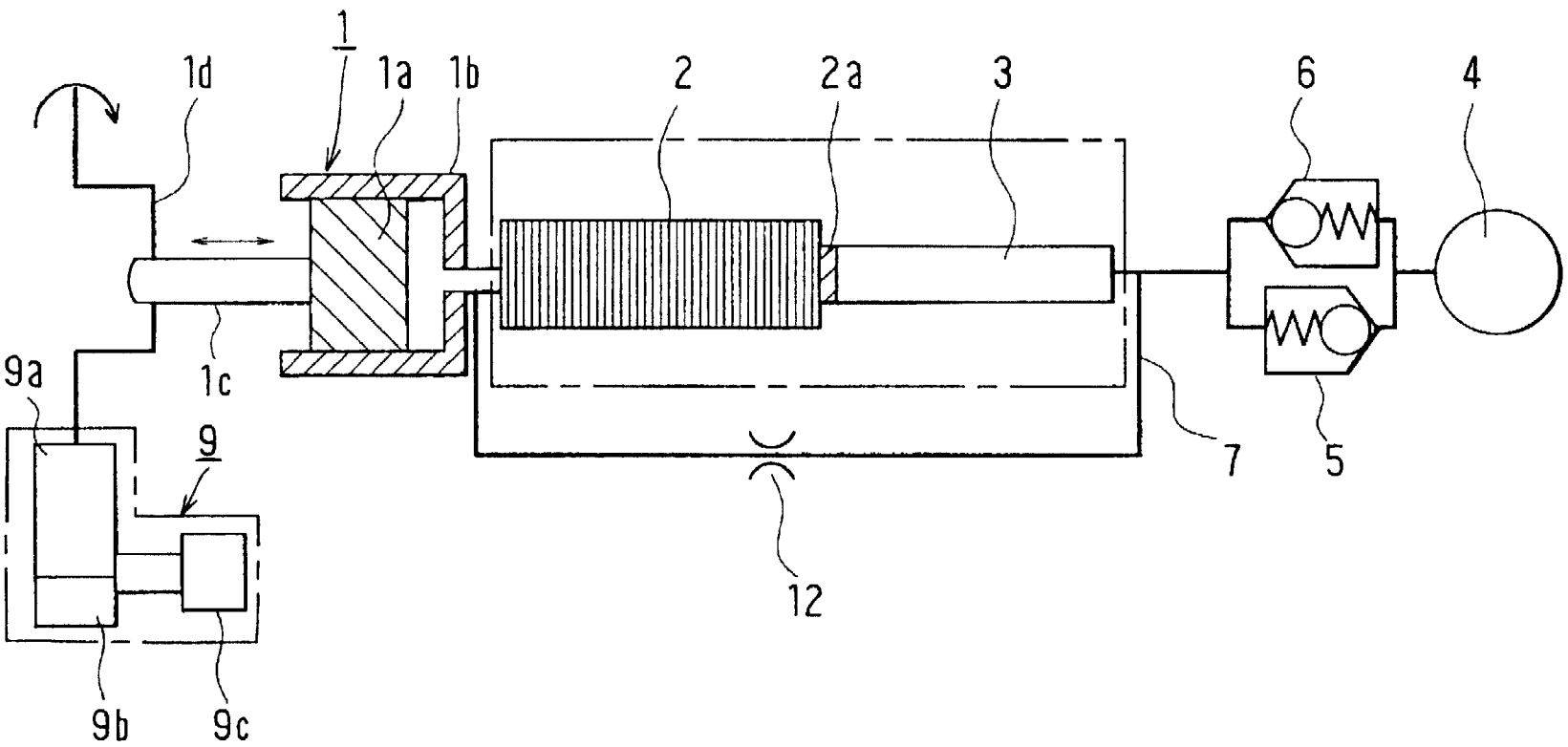
FIG. 9 is a schematic drawing showing a second embodiment of a pulse tube refrigerator according to the present invention.

The bypass pipe 7 having the electro-magnetic valve 8 can be replaced by an orifice 12 as shown in FIG. 9 as a second embodiment of the present invention. By limiting the flow of the working fluid with the orifice 12 which has an adequate flow resistance, it is possible to create a phase shift between the upstream of the orifice 12 and the downstream thereof, thus achieving a similar effect as in the system with the electro-magnetic valve 8. In the second embodiment shown in FIG. 9, all functions other than the orifice 12 are the same as in the first embodiment.

The relief valves 5 and 6 in the embodiments of the present invention can be replaced by an electro-magnetic valve which is brought to a closed position when the pressure difference between the pulse tube 3 and the buffer tank 4 is below a predetermined value and to an open position when the pressure difference exceeds the predetermined value.

Further, the electro-magnetic valve 8 installed in the bypass pipe 7 can be replaced by a mechanical valve which is operated in accordance with the pressure difference between the pulse tube 3 and the buffer tank 4.

Additionally, the main object of the present invention can also be achieved in a system in which the bypass pipe 7 having the electro-magnetic valve 8 is eliminated. In this case too, the relief valves 5 and 6 and the compressor 1 operate in the same manner as described above.

Although the present invention has been fully described in connection with the preferred embodiments thereof with reference to the accompanying drawings, it is to be noted that various changes and modifications will become apparent to those skilled in the art. Such changes and modifications are to be understood as being included within the scope of the present invention as defined by the appended claims.

What is claimed is:

1. A pulse tube refrigerator comprising:

a regenerator having a first and a second end, filled with working fluid therein, for exchanging heat between the working fluid and the regenerator;

a cool end portion connected to the second end of the regenerator for cooling an article to be cooled;

a pulse tube extending from the cool end portion to allow the working fluid to flow between the regenerator and the pulse tube;

a compressor connected to the first end of the regenerator for giving pressure and displacement to the working fluid in the regenerator;

a buffer tank connected to the pulse tube for reserving the working fluid displaced from the pulse tube; and fluid displacement control valve means disposed between the pulse tube and the buffer tank for controlling fluid flow between the pulse tube and the buffer tank, said fluid displacement control valve means being arranged in a manner such that the fluid displacement control valve means is open to allow fluid communication between the pulse tube and the buffer tank when the pressure difference therebetween reaches a predetermined value and is closed otherwise, thereby the working fluid in the regenerator being compressed or expanded without being accompanied by displacement thereof when the fluid displacement control valve means is closed, and the working fluid in the regenerator being displaced without being accompanied by compression or expansion thereof when said means is open.

2. A pulse tube refrigerator as in claim 1, further comprising:

a bypass pipe, connected between the first end of the regenerator and one end of the pulse tube which is opposite to the cool end portion, having a control valve for controlling passage of the working fluid through the bypass pipe;

wherein the bypass valve is so controlled that the bypass valve is open when the fluid displacement control valve means is closed and the bypass valve is closed when the fluid displacement control valve means is open.

3. A pulse tube refrigerator as in claim 1, further comprising:

a bypass pipe, connected between the first end of the regenerator and one end of the pulse tube which is opposite to the cool end portion;

wherein an orifice is disposed in the bypass pipe for limiting flow of the working fluid in the bypass pipe.

4. A pulse tube refrigerator as in claim 1, wherein the fluid displacement control valve means includes a first relief valve and a second relief valve both of which are normally closed and open when pressure difference between the pulse tube and the buffer tank reaches a predetermined value.

5. A pulse tube refrigerator as in claim 2, wherein the control valve is an electro-magnetic valve.

* * * * *